United States Patent [19]

Jeans

[11] Patent Number: 4,804,112

[45] Date of Patent: Feb. 14, 1989

[54] CARBONATING APPARATUS

[75] Inventor: Edward L. Jeans, Gwent, United Kingdom

[73] Assignee: Cadbury Schweppes, Plc, Birmingham, United Kingdom

[21] Appl. No.: 46,122

[22] Filed: May 5, 1987

[30] Foreign Application Priority Data

May 9, 1986 [GB] United Kingdom ..... 8611389

[51] Int. Cl.[4] ..... B67D 5/56

[52] U.S. Cl. ..... 222/129.1; 222/146.6; 261/89; 261/DIG. 7

[58] Field of Search ..... 261/DIG. 7, 89–90, 261/18.1; 137/606–607, 896; 222/129.1–129.4, 129, 132, 144.5, 145, 146.6, 190

[56] References Cited

U.S. PATENT DOCUMENTS

| | | | |
|---|---|---|---|
| 610,062 | 8/1898 | Koenig et al. | 261/DIG. 7 |
| 3,199,738 | 8/1965 | Cary et al. | 222/129.2 |
| 3,348,737 | 10/1967 | Yingst et al. | 222/129.2 X |
| 4,102,658 | 7/1978 | Jarvenpaa | 261/89 X |
| 4,148,334 | 4/1979 | Richards | 261/DIG. 7 |
| 4,444,215 | 4/1984 | Zukausky | 137/606 X |
| 4,615,466 | 10/1986 | Credle, Jr. | 222/129.1 |
| 4,688,701 | 8/1987 | Sedam | 222/129.1 |

FOREIGN PATENT DOCUMENTS

| | | | |
|---|---|---|---|
| 2021237 | 11/1971 | Fed. Rep. of Germany | 261/DIG. 7 |

*Primary Examiner*—Michael S. Huppert
*Attorney, Agent, or Firm*—Kenyon & Kenyon

[57] ABSTRACT

A carbonated beverage dispenser having a carbonating tank is described. The dispenser is for dispensing beverages comprising a concentrate and a diluent usually carbonated water. The carbonation takes place in the tank by spraying or jetting refrigerated water inside the tank and by spinning a bladed rotor inside the tank so as to intersect the jets or sprays to break up the water into atomized clouds. This is done in a carbon dioxide atmosphere inside the tank and therefore absorption of carbon dioxide takes place rapidly. A magnetic coupling between the bladed rotor and a prime mover outside the tank means that there is no need to make any break in the tank for a drive shaft. The dispenser also has facility to dispense either still water or carbonated water or a mixture depending upon the degree of carbonation required of the diluent.

14 Claims, 10 Drawing Sheets

CARBONATING APPARATUS

BACKGROUND OF THE INVENTION

This invention relates to carbonating apparatus, being apparatus for introducing a gas into a liquid, especially the introduction of carbon dioxide into a liquid, usually water, for the production of carbonated beverages.

Carbon dioxide conventionally is introduced into water which may or may not contain concentrate flavouring.

Where the water contains no concentrate flavouring, some times referred to as a syrup, carbonated water is produced, and this carbonated water may either be used for consumption or mixing in which form it is known as soda water, or the carbonated water may subsequently be mixed with a quantity of concentrate in order to provide a flavoured beverage. In the latter case, the carbonated water may be mixed with a syrup in a beverage dispensing machine, for example of the type set forth in U.S. Pat. No. 4,523,697, which essentially is designed for in-home use, or the carbonated water may be mixed with a syrup in a dispensing head of a commercial machine such as is conventionally used in restaurants, soda fountains, bars and the like.

Again, there is the factory production installation for the production of carbonated water and/or beverages, wherein a large scale carbonating plant carbonates water or water containing flavouring syrup in order to produce carbonated water and/or beverage which subsequently is bottled or canned for distribution to supermarkets and other retail outlets attended by the members of the public.

This invention has application to all of these circumstances, and in general has as its concept the introduction of a gas into a liquid, especially the introduction of carbon dioxide into water, and when the apparatus performs the latter function it is known as a carbonator. In the interests of simplicity of description, reference is made herein only to "carbonator" when referring to the apparatus, and reference is made only to carbon dioxide and water in referring to the gas and the liquid which are contacted so that the gas will be absorbed by the liquid.

The carbonating of water it will be appreciated has been practiced for many years, and a number of methods are utilized for achieving the absorption of the carbon dioxide into the water, the objective understandably always being to achieve maximum rates of absorption or in other words the take-up of the maximum amount of carbon dioxide into the water in the minimum period of time. In all cases, the carbon dioxide and water are brought into intimate contact and the carbon dioxide is absorbed into the water. The rate at which absorption takes place depends upon a number of factors including the following:

1. The temperature at which contact takes place, the general rule being that the lower the temperature which contact takes place, the higher the absorption.
2. The area of contact between the water and the carbon dioxide, the general rule being that the larger the contact area, the better the rate of absorption.
3. The pressure under which contact takes place in that the higher the pressure the higher the absorption and the higher the rate of absorption.

One of the most commonly practiced methods of bringing the water and carbon dioxide gas into contact, is to bubble the carbon dioxide gas into the lower end of a body of water contained in a carbonator and which is to be carbonated, the gas being bubbled into the carbonator in as small bubbles as possible in order to achieve maximum contact area. The temperature of the water is kept low again in order to achieve maximum absorption rates.

Other carbonators use contra flow systems. That is to say the water and carbon dioxide are caused to contact whilst flowing in opposite directions, the carbon dioxide bubbling through the water in as small bubbles as possible in order to achieve maximum contact area.

In other carbonating devices, the carbon dioxide is induced into a jet of water for example created by passing the water through a Venturi device, the carbon dioxide being aspirated into the throat of the Venturi in small bubbles in order to achieve high speed carbonation.

In yet other forms, the water is atomized into a very fine spray or mist by being forced at a high pressure through a small orifice, and the atomized water is flooded into a carbon dioxide environment. The water particles constitute a large surface area giving a large surface area of contact between the carbon dioxide and water leading to a high rate of absorption.

Of the known prior art systems outlined above, the best performance in terms of rate of absorption is achieved by the atomizing of the water to create a fine water particle or droplet mist which is flooded into a carbon dioxide atmosphere for example in a carbonator tank, but the main difficulty with this apparatus is that because of the pressures in the supply line of water necessary for achieving the fine atomization, expensive, high performance pumps are required and the expenditure involved in the purchase and maintenance of the pumps, because they operate at high speed and are prone to failure.

Producers of carbonated water therefore often utilize one of the other systems, the most common being the bubbling of the carbon dioxide gas into the lower end of a body of liquid, and tolerate relatively slow rates of carbon dioxide absorption and in some cases relatively poor levels of carbonation in favour of a system which operates reliably although rather slowly.

As to the matter of chilling the water in order to achieve a higher rate of up-take of carbon dioxide, a number of proposals are known in this regard, amongst which includes surrounding the carbonator with cooling coils or embodying such coils inside the carbonator, or in the alternative arranging for the cooling of the water prior to its being introduced into the carbonator, at a downstream location in the water supply circuit.

SUMMARY OF THE INVENTION

The present invention relates to the provision of a carbonator which operates on the principle of atomizing the water into a fine particle or droplet mist, but which is improved in comparison with the known carbonator in which an atomized water spray is created, in that atomization is achieved by a simple and reliable mechanical means, and in accordance with the present invention there is provided apparatus for absorbing gas in liquid, comprising:

(a) an absorption tank;
(b) means for introducing the liquid into the tank in the form of jets or streams;
(c) means for introducing the gas into the tank;

(d) driven mechanical means in the tank located so that when driven such means interferes with the liquid jets or streams to break up the jets or streams into atomized particle or droplet clouds which contact the gas in the tank; and (e) outlet means enabling the removal of said liquid from said tank.

It has been found that the mechanical means may conveniently be a bladed fan which is driven, and this fan can be driven by a motor via a magnetic clutch, so that there need be no physical connection between the motor located outside the carbonator tank, and the rotating fan which is rotated inside the tank.

It will be necessary to arrange for the water jets or streams to intersect the path of movement of the blades of the fan in order to achieve the atomization.

In a typical construction according to the invention, the volume of a carbonator tank for a small machine may be of the order of 1000 cc, and this tank is supplied with carbon dioxide through a carbon dioxide inlet at a pressure of 45 p.s.i. The water is supplied preferably at a low temperature of the order of 1°-4° C. through suitable inlets in order to create one or more jets or streams giving a water flow rate of 1000 cc/min, the jets or streams intersecting the blades of the fan as they rotate, such blades being rotated at a speed in the order of 5000 rpm, and with these conditions, a carbonation level of 4 volumes at the full water feed rate of 1000 cc/min is achieved which constitutes an improvement over carbonation tanks of similar capacity and construction in which carbonation is achieved by bubbling carbon dioxide gas into the bottom of a body of liquid in the manner as described herein.

It is preferable that the water be supplied to the carbonator in chilled or refrigerated condition, and to this end the water may be supplied to the carbonator after being passed through a refrigeration unit which in itself embodies a number of novel aspects. These novel aspects arise, because such a high rate of carbonation can be achieved for the carbonator according to the invention that conventional refrigerated supply systems are unable to supply sufficient water at the correct temperature to keep up with the output of the carbonator according to the invention.

The carbonator may be used in conjunction with refrigeration apparatus, for refrigerating water which is supplied to the carbonator, and in accordance with another aspect of the invention, the refrigerating apparatus includes refrigerating coils which are immersed in a body of water, the body of water serving as the means supplying the carbonator. The refrigerant may for example be any suitable liquid refrigerant such as Freon, and the Freon is passed through the cooling coils. The tubing used for the coils may comprise double layer tubing comprising an inner layer through which the Freon passes, and an outer layer providing an escape route for the Freon should the inner tube fracture resulting in leakage of the Freon from the inner tube into the inside of the outer tube. In this connection, the outer tube may comprise a plastics material tube which is a relatively neat fit on the inner tube except that a means such as a copper wire or the like is extended along the outside of the inner tube so as to provided a gallery along which the Freon can escape without contacting the body of water should a leak occur. It is believed by adopting this arrangement, such a refrigerating apparatus would meet the safety standards set for refrigerating apparatus. In this connection it should be mentioned that it is usual for the body of water to be refrigerated by encircling a tank containing the water with the refrigeration coils.

In connection with the dispensing of beverages, in particular carbonated beverages, it is the case that it is usual for this particular system, where the mixing of the carbonated water and flavouring takes place within the system, to be provided with a single carbonated water supply which cannot selectively be varied as to the level of carbonation, and in particular cannot have delivery of still water, as opposed to carbonated water, to the mixing head.

In a system where the concentrate is for example contained in a disposable and removable package, then it would be of advantage to provide the facility that the system can accept and receive packages containing concentrate which is for mixing with still water as opposed to carbonated water, or carbonated water of a much lower carbonation level than that which is normally supplied by the system.

According to another aspect of the present invention therefore there is provided beverage dispensing apparatus for the dispensing of carbonated liquid comprising:

(a) a still liquid supply;

(b) a carbonating tank;

(c) means connecting the still liquid supply to the carbonating tank;

(d) a carbonating tank outlet by which carbonated liquid may be discharged from the tank;

(e) a branch connection from the still liquid supply; and (f) a mixing valve having first and second inlets and an outlet, said carbonating tank outlet being connected to the first mixing valve inlet and the branch connection being connected to the second mixing valve inlet, so that carbonated liquid and still liquid can be mixed in said valve and the mixture dispersed from the mixing valve outlet.

According to another aspect of the invention there is provided beverage dispensing apparatus for the dispensing of carbonated liquid comprising:

(a) a still liquid supply;

(b) a carbonating tank;

(c) means connecting the still liquid supply to the carbonating tank;

(d) a carbonating tank outlet by which carbonated liquid may be discharged from the tank;

(e) a branch connection from the still liquid supply; and (f) a still liquid outlet from said branch connection whereby still liquid or carbonated liquid may be dispensed selectively from the apparatus.

It can be seen therefore that the beverage dispensing apparatus can include still water supply, a carbonator for carbonating the still water supply, an outlet from the carbonator leading to a dispense head from which carbonated water and concentrate can be dispensed to provide a beverage, and wherein there is a branch connection from the still water supply line whereby still water may be led to the dispense head whereby the diluent to be mixed with the concentrate may comprise, selectively, still water, or carbonated water, or a mixture at intermediate carbonation of the water from the carbonated water supply and water from the still water supply.

The mixing valve may have control orifices for controlling the quantity of still water and water from the carbonating unit which flow through the valve from zero to a maximum so that the diluent which is supplied from the mixing valve to the dispense head can vary between diluent have maximum carbonation level equal to that of the carbonated water issuing from the carbonator, to zero the carbonation level of the still water from the supply.

The orifices in the mixing valve may be variable by any suitable means, but it is preferred that in a relatively small compact machine for in-home use, they ar adjusted manually. Sophisticated control means can be used for larger installations.

In another arrangement of this aspect of the invention, which may be used as an alternative to or in addition to the previous arrangement, the dispensing system has two or more dispensing heads at which concentrates of different flavour and composition and for mixing with diluents of different carbonations are provided, and to the respective dispensing heads are connected diluent supplies deriving from the same still water inlet, a first of said supplies being a still water supply, a second of which being a supply direct from the carbonating tank, and a third being a supply made up of a blend of still water from the still water supply and carbonated water from the carbonating tank, the latter supply being through a mixing valve as above described.

In the first and second supplies, there may be an orifice through which the diluent is supplied, such orifice being adjustable as to size in order to control the rate of flow of the diluent through such orifices. The orifice in the first and second supplies may be adjusted manually or by any other suitable means. With this aspect of the invention, it can be seen that there is considerable flexibility in water supply, ranging from still water on the one hand, to carbonated water at maximum carbonation direct from the carbonating tank on the other hand, with the possibility of providing diluent of an intermediate carbonation level, and this has not heretofore been provided in beverage dispensing systems.

BRIEF DESCRIPTION OF THE DRAWINGS

Embodiments of the present invention and its various aspects will now be described, by way of example, with reference to the accompanying drawings, some of which are diagrammatic, and wherein.

DETAILED DESCRIPTION

Figure 1:
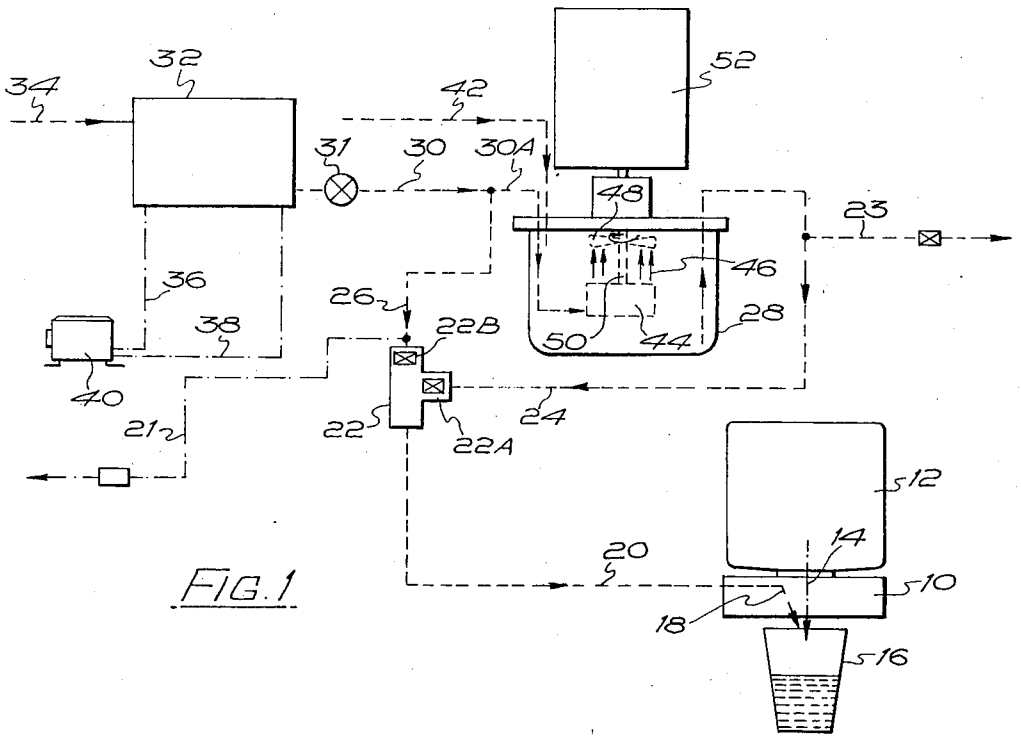
FIG. 1 is a diagrammatic elevation of a beverage dispensing system.

Referring to the drawings, and firstly to FIG. 1, a system for dispensing carbonated beverage comprises a dispensing valve or head 10 which receives a cartridge bottle or container 12 of syrup which is inserted in the dispensing valve 10 in inverted condition. The valve 10 and a cartridge 12 may be essentially as described and illustrated in U.S. Pat. No. 4,523,607 incorporated hereinto by reference. The dispensing valve 10 operates on the package 12 to allow syrup to flow under metered conditions as indicated by arrow 14 from the container 12 into a drinking vessel such as a cup 16, and at the same time the valve 10 allows the passage of diluent as illustrated by arrow 18 from a supply line 20 through the dispense valve 10 and out of an outlet thereof so that the diluent and syrup are dispensed simultaneously into the drinking vessel 16 to provide a beverage. When the dispensing valve 10 is turned to the initial position, flow of syrup and diluent cease, and therefore the system is designed to dispense any quantity of beverage as desired, although in a modified form the dispenser may be batch type in which at each operation of the dispensing valve dispense a pre-set quantity of diluent and concentrate are dispensed.

The diluent line 20 extends from a proportioning valve 22 having two inlets effectively connected to supply lines 24 and 26. Line 24 carries carbonated and chilled water from a carbonating vessel 28, whilst line 26 is coupled to an output line 30 of a refrigeration unit 32, so that line 26 receives chilled but still water. The proportioning valve 22 is provided with control orifices 22A 22B respectively adjustable to control the quantity of still water which flows through the valve and the quantity of carbonated water from the carbonator which flows through the mixing valve. These orifices 22A, 22B are adjustable, in this case manually, between maximum and minimum (zero) flow position whereby at the outlet line 20 of the mixing valve there can be delivered water of a carbonation varying from zero carbonation when only still water is supplied through the valve and the orifice 22A is closed to the delivery of water with maximum carbonation when carbonated water from the carbonating tank flows directly through the valve and the orifice 22B is closed. Any intermediate position can be adopted wherein the orifices 22A, 22B are more or less closed or open. The level of carbonation which is selected will depend upon the quality and nature of the concentrate which is being dispensed from the dispensing head simultaneously with the diluent.

Alternatively or additionally, where a plurality of dispensing heads are provided, and which can respectively receive concentrates of different quality and type for dilution with diluents of different carbonation levels, a still water branch pipe 21 may be taken to a first dispensing head, whilst a second branch pipe 23 may be taken direct from the carbonating tank outlet to a third dispensing head, the first and third dispensing heads being connected in the same manner as the head shown in FIG. 1.

It can be seen therefore that in the first dispensing head only still water is delivered, and therefore only appropriate concentrates will be dispensed therefrom, whilst in the third dispensing head concentrates requiring dilution with diluent having high carbonation level will be dispensed.

Such an arrangement provides considerable flexibility of dispensing, as heretofore it has not been provided from a single still water supply, the capability of delivering diluents of varying carbonation level.

The water in line 30 may typically be at a pressure of 20 psi. The line 30 also leads to the carbonator 28 through a branch line 30A. The water is supplied to the refrigeration unit through a mains line 34 connected to the water mains, and the water contained in the unit 32 is refrigerated by means of a refrigeration circuit including the lines 36 and 38 and compressor 40. Carbon dioxide is supplied to the carbonator 28 in order to carbonate the water therein through a supply line 42 and as shown in FIG. 1, the carbonator 28 contains a pump head 44 from which the water supplied through line 30A emerges as vertically rising jets 46, and these jets interfere with rotating vanes or paddles 48 carried on a shaft 50. Shaft 50 is rotated by means of a drive motor 52 located outside the carbonator. The purpose of the bladed fan or rotor 48 is to mechanically intersect the travelling water jets 46 in order to atomize the water into a cloud of water particles which, as explained herein in coming into contact with the carbon dioxide atmosphere which will exist inside the carbonator 28 by virtue of the supply of $CO_2$ through line 42, results in the particles becoming impregnated and in some cases saturated with carbon dioxide. The water particles gravitate downwards into the base of the carbonator so as to coalesce and become a body of carbonated water. As the water supplied through line 30A has already passed through the refrigeration apparatus 32, the uptake of carbon dioxide will be enhanced. The carbonated water is then drawn through line 24 to the proportioning valve 22.

The proportioning valve 22 is capable of adjustment in position to provide that either still water can be supplied over line 20, or carbonated water can be supplied over line 20 from line 24, or there can be a mixture of the still water supplied through line 26 and carbonated water supplied through line 24 to give the required degree of carbonation in the final drink in container 16.

Line 30 contains a temperature sensor in order to sense the temperature of the water emerging from the refrigeration unit 32. If the temperature of this water is higher than a pre-set level typically 38° F., the sensor 31 senses this and causes the pump supplying the water to the dispensing system to stop.

Figure 2:
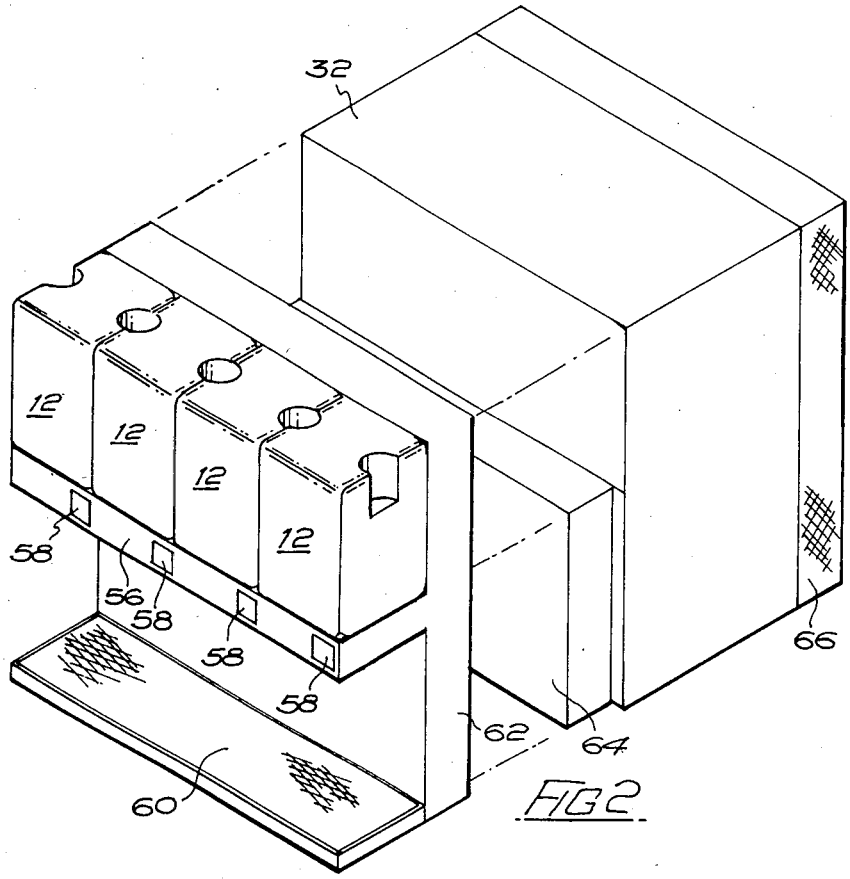
FIG. 2 is a perspective elevation showing a specific embodiment of a beverage dispensing system operating according to the principles illustrated in FIG. 1.

By providing that the water jets 46 are mechanically agitated and broken up by means of the rotor 48, a relatively low powered drive motor can be used and it is not necessary to use a high pressure pump to achieve atomization as was previously the case. Referring now to FIG. 2, a complete dispensing apparatus is illustrated, and it will be seen to comprise four syrup containers 12 engaged in a manifold 56 containing four dispensing valves and four pushbuttons 58 for operating the respective valves either continuously or, by electrical timer means, for a preset time for batch delivery.

Figure 3:
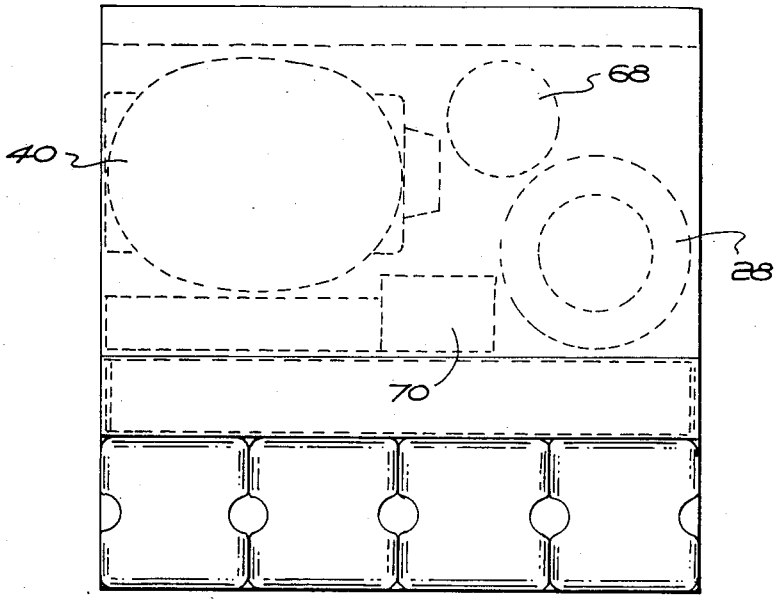
FIG. 3 is a plan of the apparatus shown in FIG. 2.
Figure 4:
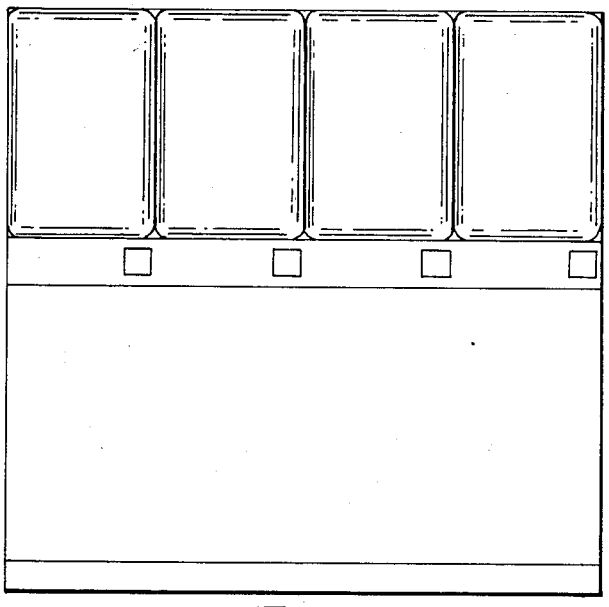
FIG. 4 is a front view of the apparatus shown in FIG. 2.

The manifold 56 has the appropriate outlets on the underside thereof for the syrup and diluent, and is located above a drip tray 60 on which the vessels such as vessel 16 are placed in order to catch the dispensed beverage. The manifold is connected to an upright support frame 62 which is hollowed out to the rear thereof so as to receive a fitting projection 64 on the refrigeration apparatus cabinet 32. The cabinet 32 is provided to the rear with a cooling air intake grill 66, and as shown in FIG. 3, the compressor 40 is in fact contained within the cabinet 32. Also contained within the cabinet 32 is the carbonator 28 and a recirculation pump 68. A solenoid 70 in the cabinet 32 is for controlling the supply of $CO_2$ to the dispense head.

The cabinet 32 has couplings capable of being slid into operative position with couplings in the rear of the frame 62 as will be understood from FIG. 2, or it can be removed and located remotely therefrom, there being in such arrangement appropriate pipes connecting said couplings to ensure that the diluent, $CO_2$ and electricity will be supplied from the cabinet 32 to dispensing valves.

Figure 6:
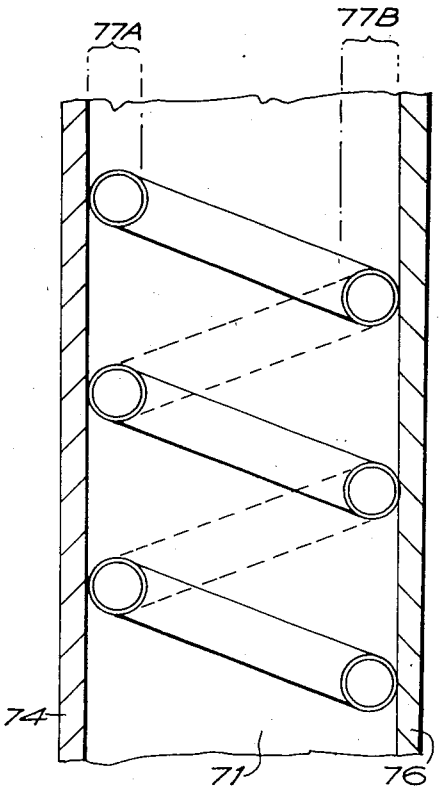
FIG. 6 is a sectional elevation of the condensor tubes as shown in FIG. 5, the section being taken on the line A—A in FIG. 5.
Figure 5:
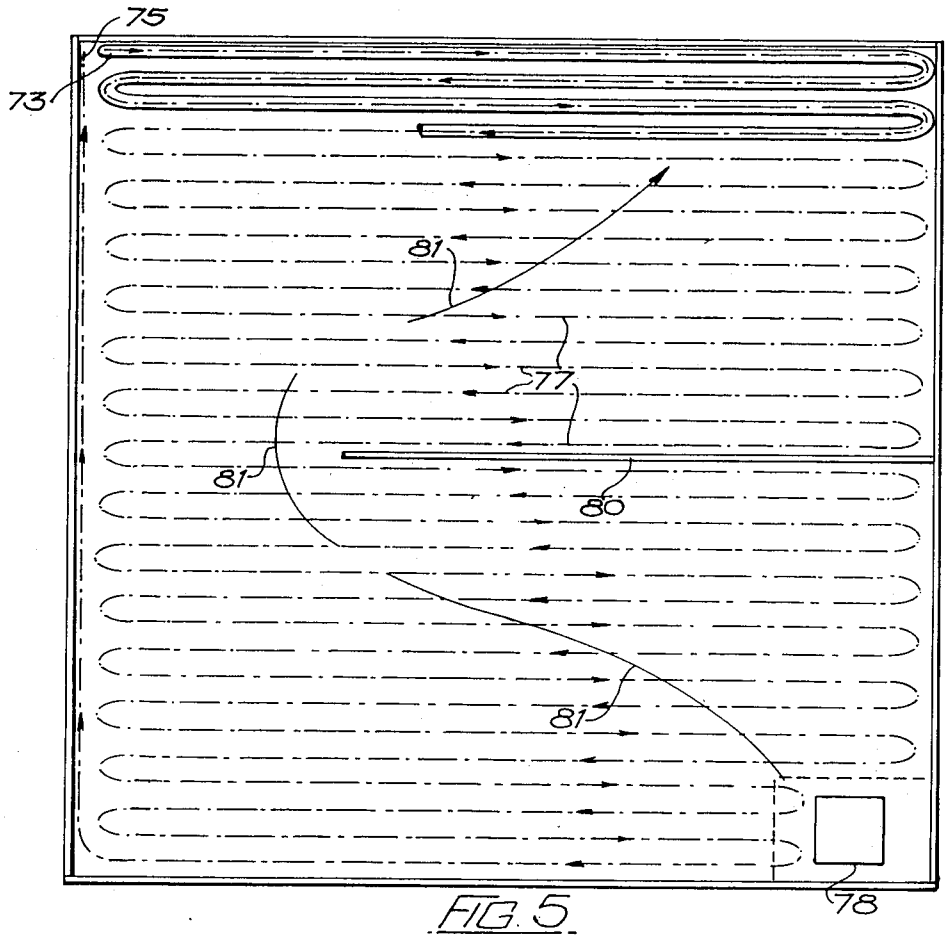
FIG. 5 is a view of the rear of the refrigerating section of the apparatus shown in FIG. 2.

Referring in FIGS. 5 and 6, the condenser coil 70 is located in the rear of the cabinet between front and rear walls 74, 76 defining a narrow chamber 71 extending for the height and width of the cabinet. The coil 70 has an inlet end 73 at the top of the cabinet, and the coil 70 serpentines back and forth across the width and progressively downwards in the chamber until it reaches the bottom end of the chamber, from whence a return section of the coil 70 is taken to an outlet end 75 also at the top of the chamber. The coil is made up of straight portions 77 extending for substantially the width of the chamber, and these straight portions are joined at the ends by semi-circular linking portions 79 which at each end also drop in level so as to connect with the next lower straight portion. The straight portions 77 therefore form in fact two banks 77A, 77B of which the straight portions in each bank are in vertical alignment, with the two banks 77A, 77B respectively adjacent the respective plates 74, 76 defining the chamber 71. Air is drawn through the chamber by a suitable fan in order to remove heat from the condenser coil, and the air enters at an inlet 78 at the bottom of the chamber and is discharged from an outlet at the top of the chamber. A horizontal baffle 80 located mid-way of the chamber splits the coil into upper and lower sections, and ensures that the air travels as indicated by the arrows 81, giving effective flow over the respective coil sections. The straight portions 77 of the coils are connected by a conductive strap material such as copper tape, this tape being woven across the straight sections 77A, 77B. The tape is heat conductive, and its purpose is to provide an effective enlargement of the surface area of the coils for the effective removal of the heat therefrom.

Figure 7:
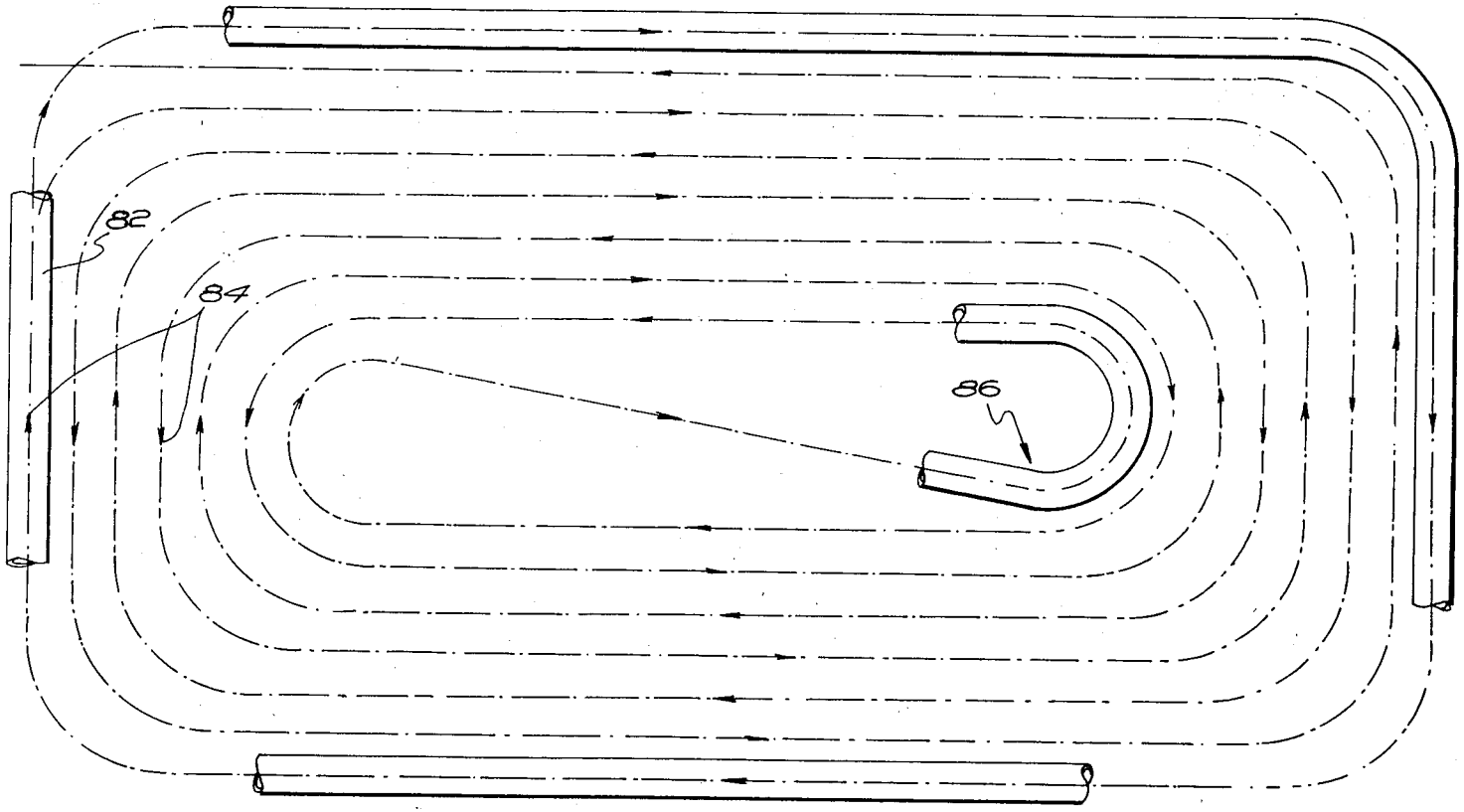
FIG. 7 is a plan view of an evaporator coil embodied in the refrigeration system of the apparatus shown in FIG. 2.
Figure 8:
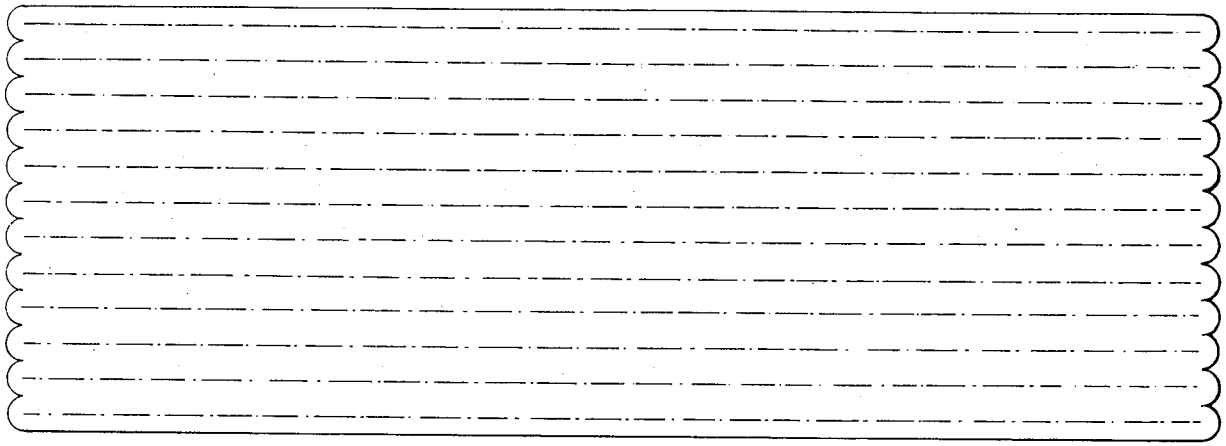
FIG. 8 is a side view of the coil shown in FIG. 7.
Figure 9:
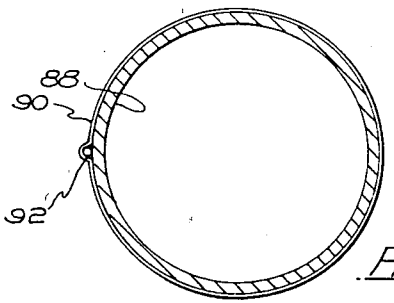
FIG. 9 is a sectional enlarged view through the tubing used for the coil.

The evaporator coil of the refrigeration system is shown in FIG. 7, and will be seen to comprise a coil 82 through which the refrigerant is passed in the manner as indicated by the arrows 84. The coil 82 although it coils about a rectangular path to define four walls, at the base it spirals inwardly to a central region 86 whereat it is either turned back upon itself and the returning spiral is interleaved with the coils of the inwardly travelling spiral, or forms a simple spiral. The coil in fact defines an open topped box in which ice can grow. This coil is constructed of tubing of the construction shown in FIG. 9 which comprises an inner tube 88 of copper on the outside of which is a heat shrinkable plastics tube 90. Prior to the placement of the heat shrinkable plastics tubing on the outside of the copper tube a small 0.5 mm diameter copper wire 92 is laid in the outside of the copper tube so as to extend axially thereof. Thus when the plastics material tube 88 is shrunk into position, it will contact the outer surface of the copper tube 88 over its entire periphery except at the opposite sides of the copper wire 92 where narrow air passages will be formed. These passages in fact form galleries along which the leaking gas can escape should in fact the inner copper tube 88 fracture resulting in leakage of the refrigerant through the copper tube and into the galleries adjacent wire 92. This measure is necessary and desirable because in accordance with another aspect of the present invention, it is suggested that the coil 82 be placed in a body of water in order to refrigerate same, and that body of water is used as the supply for supplying line 30 of the beverage dispensing system as shown in FIG. 1. The coil 82 may be provided with associated control means in order to limit the build-up of ice on this coil during running of the refrigeration apparatus.

An alternative construction of the coil 82 is to construct it based upon a double walled version of The Roll Bond (Trade Mark) technique.

Figure 10:
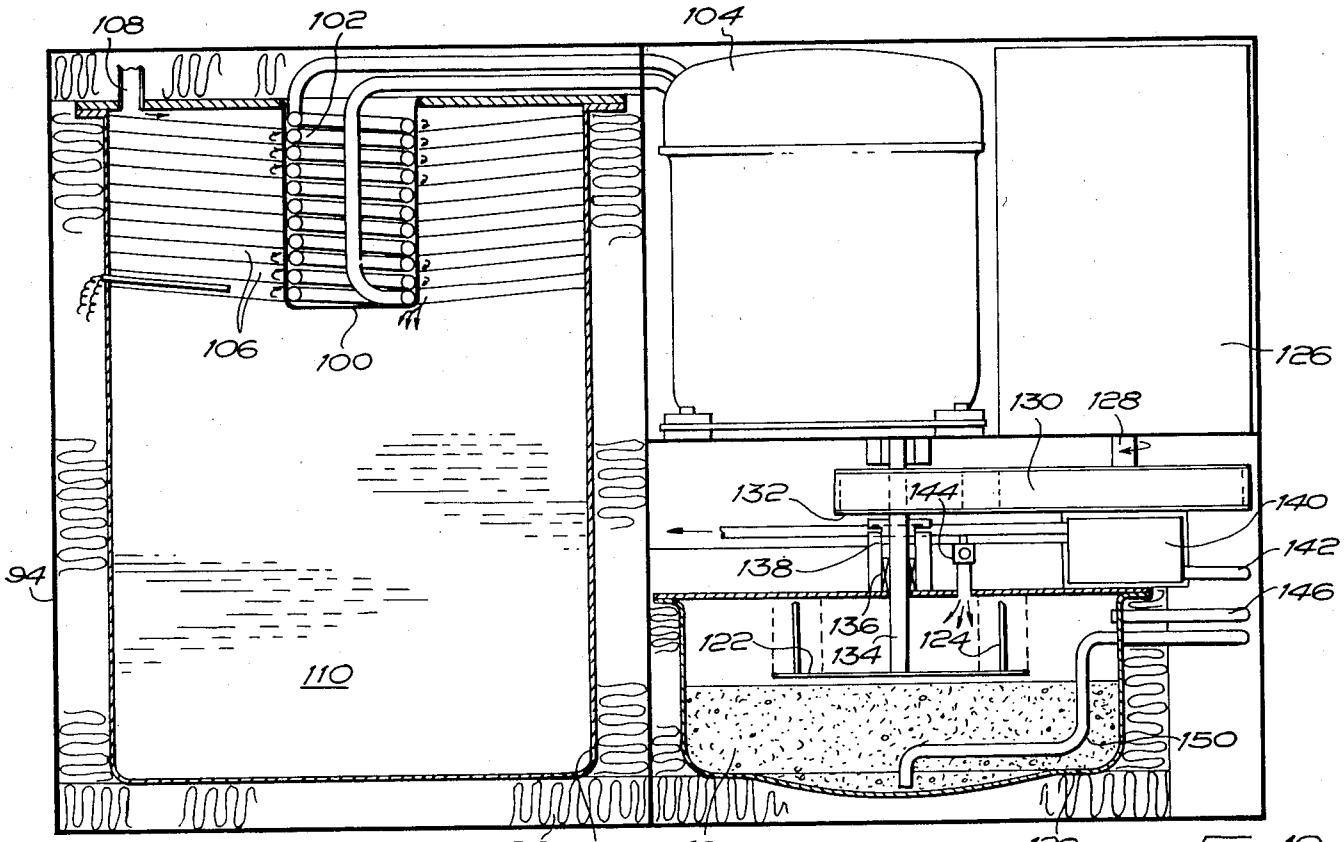
FIG. 10 is a sectional elevation of a refrigeration and carbonating system embodying the principles of the invention, but which is a modified construction compared to the arrangement shown in FIGS. 2 to 9.

FIG. 10 shows an alternative refrigeration system and carbonator arrangement embodying the principles of the present invention. As shown in FIG. 10, the apparatus comprises a cabinet 94, the interior of which is insulated by heat insulating material 96, and such material supports a water supply tank 98 and in a sub-tank 100 at the top of tank 98 are evaporator coils 102 of the refrigeration system, the compressor being indicated by numeral 104. Feed trays 106 surround the sub-tank 100 so that inflowing mains water passing through the inlet 108 will cascade down the trays 106 so as to contact the sub-tank 100 thereby to achieve maximum cooling of the incoming water. The chilled water forms a body 110 in the tank 96.

The carbonator tank 120 again contains a rotor 122 with upstanding blades or paddles 124 which are rotated by means of a motor 126 located outside the carbonator, and driving through a shaft 128, a toothed belt 130. The toothed belt 130 engages a pinion 132 on the shaft 134 which carries the rotor 122. The shaft is supported on bearings 136 and its sealing packing rings 138 are provided to prevent the leakage of carbon dioxide past the shaft 134. A pump 140 draws water from the body of water 110 through an inlet pipe 142, and delivers the water through a one-way valve 144 into the carbonator in the region above the rotor 122, so that the incoming stream or jet of water will be engaged by the rotor 122 and will be atomized by virtue of the rotors rotation and mechanical working on the incoming jet or stream. The atomized water comes into intimate contact with the surrounding atmosphere of carbon dioxide, carbon dioxide being supplied through inlet pipe 146, and the particles quickly absorb and in some cases become saturated with carbon dioxide and then fall into the base of the carbonator so as to form a body 148 of carbonated water which can be drawn through outlet pipe 150 for supply to the dispensing valves in the dispensing head, such as the dispensing valves in the manifold 58 shown in FIG. 2.

Figure 11:
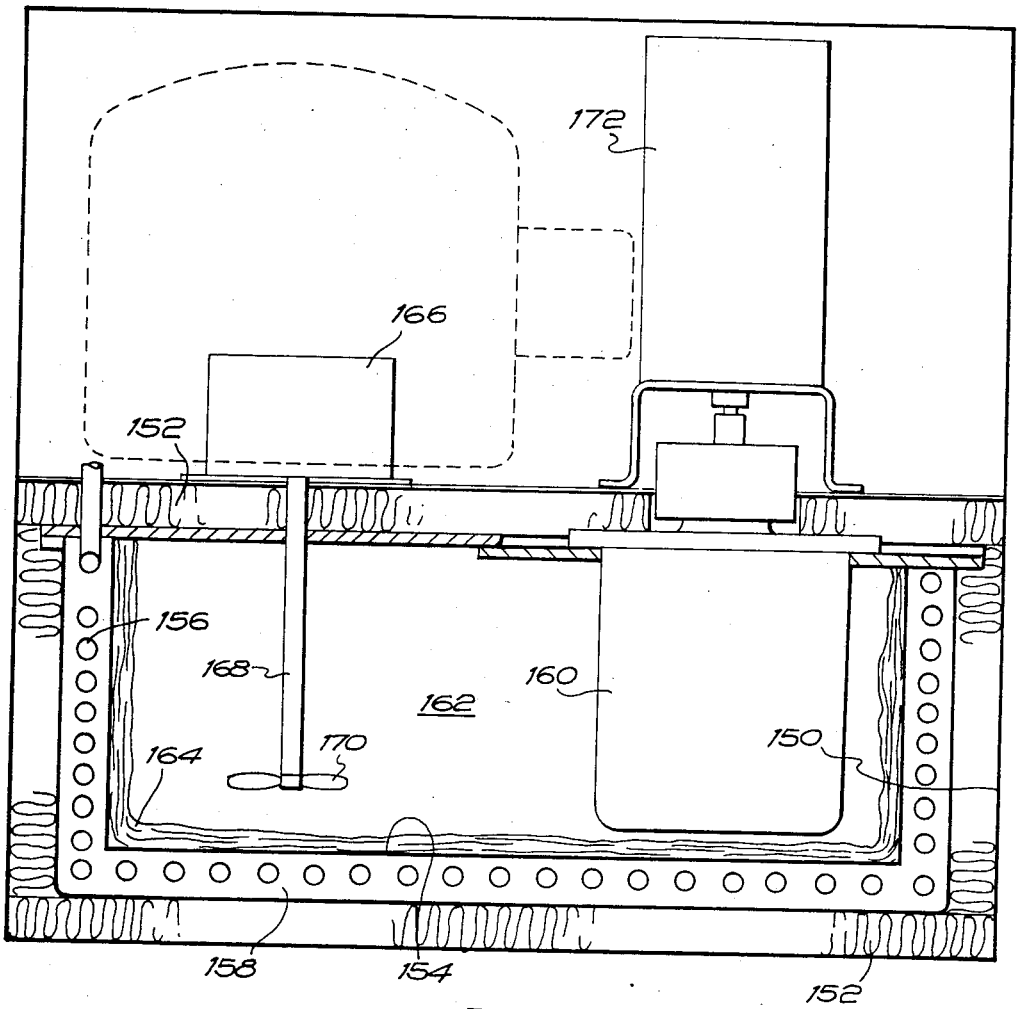
FIG. 11 is a sectional elevation showing an arrangement similar to FIG. 10, but according to another embodiment of the invention.
Figure 12:
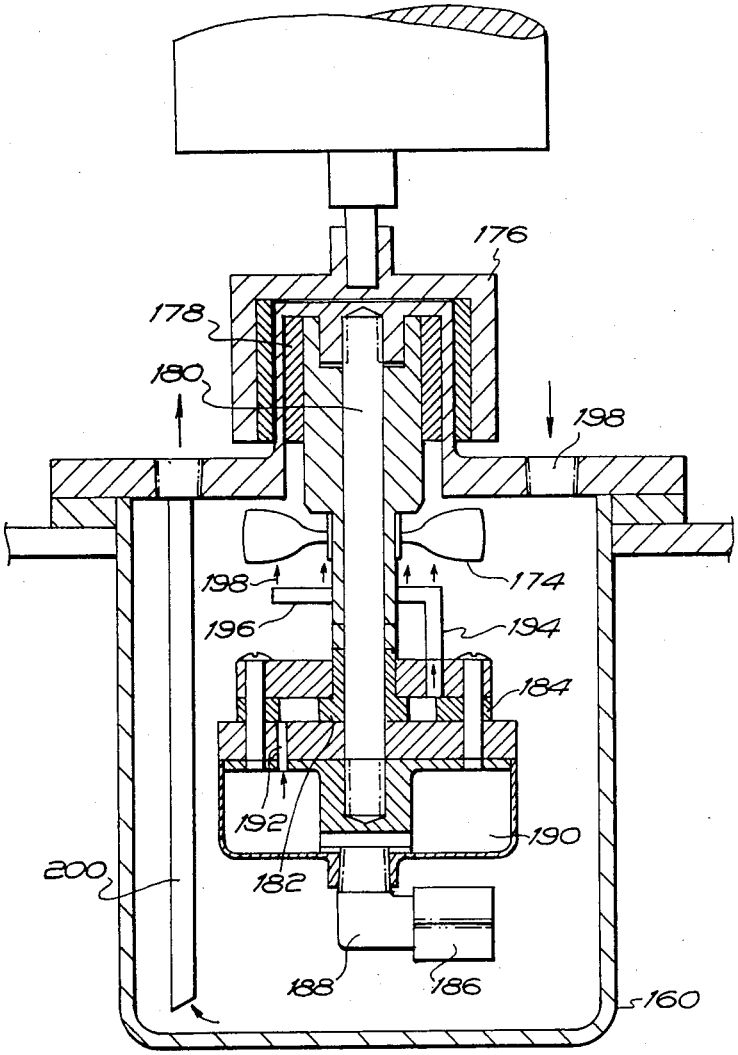
FIG. 12 is a sectional elevation of the carbonator arrangement of the apparatus shown in FIG. 11.

FIGS. 11 and 12 show a further arrangement which is similar in operation to the FIG. 10 arrangement, but is somewhat different in the construction and therefore only the major differences will be described.

Referring to FIG. 11, the cabinet is illustrated by numeral 150, the insulation by 152, and the water tank by 154. In this case, the refrigerating coils 156 are embodied in a layer surrounding the tank 154, the layer is referenced 158 and lies between the tank 154 and the insulation 152. The carbonator 160 lies in the body of water 162 contained in the tank 154 and in this case ice 164 will be built up on the inner wall of the tank 154 as shown. A paddle motor 166 located outside tank 154 but driving a shaft 168 which extends into the tank 154 and carrying an agitating paddle 170, is provided. Paddle 170 keeps the body of water 162 in circulation inside the tank 154.

The motor 172 is for driving the paddle (see FIG. 12) 174 inside the carbonator tank 160, and in this case the motor drives a magnetic coupling 176 which in turn rotates an armature 178 which is inside the carbonator tank 160, but there is no mechanical coupling between rotor 176 and armature 178, and therefore this construction overcomes the difficulty which existed with for example the FIG. 10 construction that carbon dioxide can sometimes leak past the gland 138. Armature 178 is fast with the paddle 174 and the assembly 178/174 is rotatable round fixed shaft 180. A dog drive couples the assembly 178/174 to drive the rotor 182 of a lobed or eccentric pump of which the stator is indicated by reference 184. This pump draws water from the still water tank 162 through a filter 186, an inlet pipe 188 and into a chamber 190. From the chamber 190 the water is drawn through an inlet 192 into the lobed or eccenric pump, and then is discharged at sufficient pressure through an outlet pipe 194 having a manifold 196 through which jets of water 198 issue upwardly and into the path of rotation of the paddle 174. As a result, and in keeping with the other embodiments, the jets of water are atomized so as to form a cloud of particles which contact carbon dioxide atmosphere by virtue of the supply to the interior of the carbonator of carbon dioxide through inlet 198. Reference 200 indicated an outlet pipe from which carbonated water can be drawn.

Figure 13:
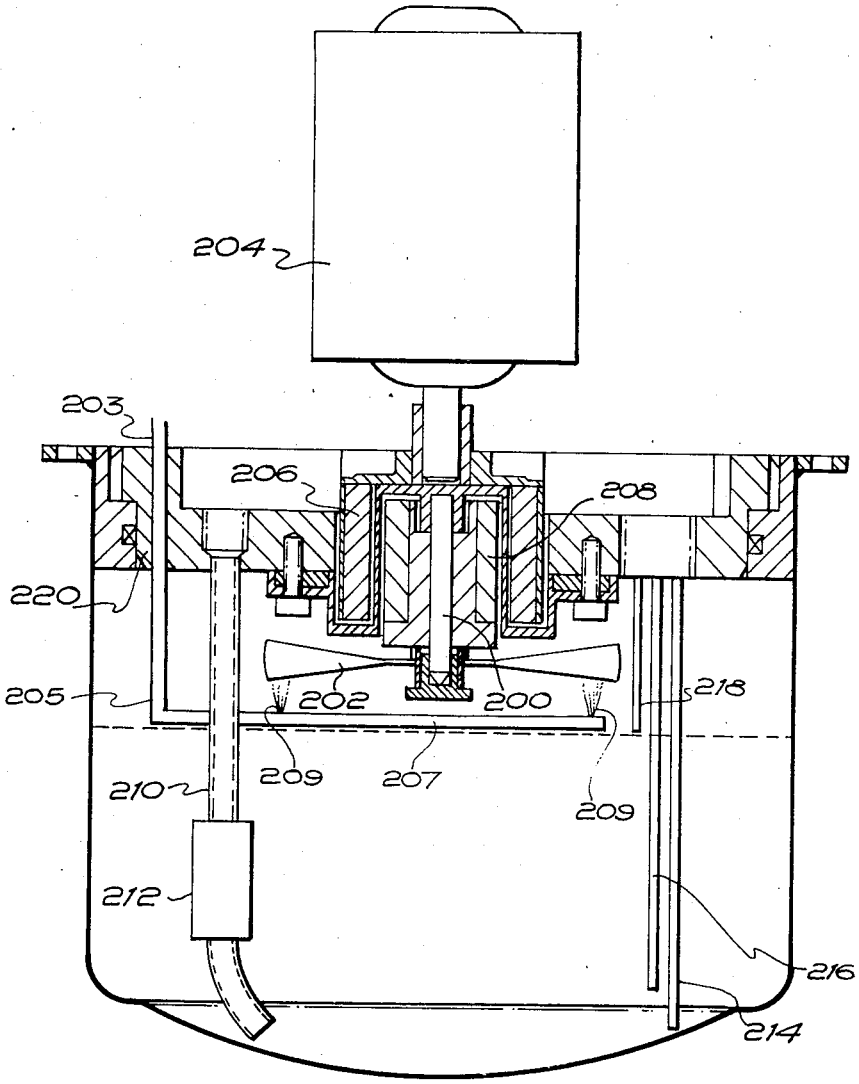
FIG. 13 is a sectional elevation of a carbonating arrangement according to a particularly preferred embodiment of the invention.

FIG. 13 shows simply a modified form of motor drive and carbonator arrangement which is somewhat similar to the arrangement shown in FIG. 12 except that the pump for pumping the chilled water upwardly into the path of the bladed rotor 202 is external to the carbonator, and the shaft 201 which carries the rotor 202 has no extension such as that shown in FIG. 12. The drive motor 204 drives a magnetic coupling 206 and this by magnetic induction drives an armature 208 which is inside the cabinet and carries the shaft 201, so that there is in fact no mechanical coupling between the motor and the rotor.

In this embodiment of the invention the water is pumped into the tank through an inlet tube 203 which at its lower end 205 leads to two spray arms 207 having jet outlets 209 from which the water is jetted upwardly into the path of rotation of the blades 202 so that the water will be atomized as herein described for the effective carbonation of same by intimate contact with the carbon dioxide atmosphere inside the carbonator. There is also a carbon dioxide inlet to the carbonator, which is not shown in FIG. 13. The inlet may be a simple tube through the lid 220 of the carbonator or a tube which extends to the bottom of the carbonator and is provided with a diffuser of sintered metal, glass or plastic for distributing the carbon dioxide through the water to the head space. Carbonated water outlet pipe 210 is shown, and it does contain a pressure reducing valve 212 in order that carbonated water will be delivered at the outlet at a reduced pressure compared to that inside the carbonator.

All of the carbonators will be provided with appropriate level sensors of which there are various embodiments. In FIG. 13 the level sensor indicated comprises three level sensing electrodes 214, 216 and 218. This is to ensure that the water level in the carbonator does not reach a level on the one hand so that the bladed rotor becomes immersed, or so that on the other hand the carbonator does not become starved of water. To control the maximum level in the FIG. 13 embodiment there is provided the upper level electrode 218, whilst to control the lower level is provided the lower level electrode 216. Sensor 214 is the common electrode to provide the condition path to each of other electrodes 216, 218.

The carbonator construction of FIG. 13 embodies a cover or lid 220 which carries the various inlets and outlets and the level sensing probes, as well as the magnetic coupling, armature and shaft and rotor assembly 201/202.

It can be seen that the invention provides in its various embodiments a means for the effective and efficient carbonating of water by ensuring that the incoming water is mechanically worked so as to atomize same in a carbon dioxide atmosphere.

Additionally, there is no reason why the concept of the present invention cannot be applied to the absorption of gases and liquids in general.

Additionally, certain advantages are achieved in relation to the refrigeration side of the apparatus insofar as the evaporation coil is designed to be at least in one embodiment immersed in the body of water to be chilled, and appropriate designs are effected to provide for safety in that a double walled construction is used for the tubing of the evaporation coil so that if there is a leak of refrigerant, this must pass through two walls before it can contaminate the water which is to be used for the beverage consumption.

I claim:

1. Apparatus for absorbing gas in liquid, comprising:

(a) an absorption tank;

(b) means for introducing the liquid into the tank in the form of jets or streams;

(c) means for introducing the gas into the tank;

(d) driven mechanical means in the tank located so that when driven such means interferes with the liquid jets or streams to break up the jets or streams into atomized particle or droplet clouds which contact the gas in the tank;

(e) outlet means enabling the removal of said liquid from said tank; and (f) a refrigeration unit connected to the means for supplying the liquid so that liquid supplied to the tank passes first through the refrigeration unit and then through the said means for supplying the liquid, said refrigeration unit comprising refrigeration coils for refrigerant, a container containing said coils, inlet means for introducing the liquid into the container, and outlet means connected to said means for supplying liquid, the said refrigeration coils being of tubing comprising an inner layer through which the refrigerant passes and an outer layer arranged so that any refrigerant escaping from the inner layer can escape inside the outer layer without contacting the liquid in the container.

2. Apparatus according to claim 1, wherein the driven mechanical means comprises a bladed fan.

3. Apparatus according to claim 2, including a magnetically drivable member connected to said fan, and outside the tank, a magnetic drive member magnetically clutch coupled to the drivable member, and a prime mover drivingly connected to the magnetic drive member.

4. Apparatus according to claim 2, wherein said means for introducing liquid comprises a pipe means having outlet apertures therein through which the liquid issues as upwardly travelling jets which intersect with the plane of rotation of said bladed fan.

5. Apparatus according to claim 1, wherein the outer layer is of plastics material and there is a copper wire between the inner layer and the plastics tube providing said escape route.

6. Apparatus according to claim 1, wherein said refrigeration coils define a rectangular box shape having a base and a wall.

7. Apparatus according to claim 1, wherein the refrigeration unit includes an evaporator coil arranged in a casing so that lengths of the coil lie in the casing in two parallel planes, and including air inlet means and air outlet means in said casing at opposite sides of the casing.

8. Apparatus according to claim 1, wherein said absorption tank is located in a refrigeration tank containing the said liquid, and said coils are located to cool the liquid in said refrigeration tank.

9. Apparatus according to claim 8, including a stirring device in the refrigeration tank and a stirrer drive motor connected to said stirring device to drive same.

10. Apparatus according to claim 1 in combination with a beverage dispenser wherein said liquid is a drinkable liquid and the gas is carbon dioxide, said beverage dispenser comprising a beverage dispense head from which the carbonated drinkable liquid can be dispensed and including a dispense head connected to the absorption tank to receive the carbonated liquid therefrom, said absorption tank, refrigeration unit and a supply of carbon dioxide being contained in a unit which is detachably connected to the dispense head by being a plug fit thereto and being unplugable therefrom so as to be capable of positioning at a remote location while remaining operatively connected to the dispense head.

11. Apparatus according to claim 10, wherein said dispense head includes several concentrate containers containing concentrate to be mixed with the carbonated liquid to produce a beverage and each having an openable and closeable outlet, means mounting the concentrate containers in the dispense head, means actuable to dispense beverages from the dispense head by opening the selected concentrate outlet, and means connecting said means actuable with the outlet means of the absorption tank to permit dispensing of concentrate and carbonated liquid simultaneously.

12. Apparatus according to claim 1, wherein said means for introducing liquid into the tank comprises a passage, said passage having a branch connection by which still liquid which does not enter the absorption tank can be drawn from the apparatus.

13. Apparatus according to claim 12, including a mixing valve having first and second inlets and an outlet and wherein said branch connection is connected to one of said first and second inlets and the outlet means from the absorption tank is connected to the other of said first and second inlets, said mixing valve being adjustable to adjust the proportion of still liquid and gassified liquid which issues from the mixing valve outlet.

14. Apparatus according to claim 13, wherein said passage has a second branch connection leading to a still liquid outlet, and the outlet means of the absorption tank has two outlets, one leading to said mixing valve and the other leading to a separate gassified liquid outlet.

* * * * *